US008742990B2

(12) United States Patent
Hung et al.

(10) Patent No.: US 8,742,990 B2
(45) Date of Patent: Jun. 3, 2014

(54) CIRCULAR POLARIZATION ANTENNA

(75) Inventors: Kuo-Fong Hung, Changhua (TW); Shih-Wei Hsieh, Taipei (TW); Ho-Chung Chen, Taipei (TW); Mao-Lin Wu, Jhubei (TW)

(73) Assignee: Mediatek Inc., Hsin-Chu (TW)

( * ) Notice: Subject to any disclaimer, the term of this patent is extended or adjusted under 35 U.S.C. 154(b) by 281 days.

(21) Appl. No.: 13/339,738

(22) Filed: Dec. 29, 2011

(65) Prior Publication Data

US 2013/0169494 A1 Jul. 4, 2013

(51) Int. Cl.
*H01Q 1/24* (2006.01)

(52) U.S. Cl.
USPC ..... 343/700 MS; 343/789; 343/846

(58) Field of Classification Search
CPC ..... H01Q 13/18; H01Q 21/061; H01Q 21/24
USPC ..... 343/700 MS, 789, 846
See application file for complete search history.

(56) References Cited

U.S. PATENT DOCUMENTS

| | | | | |
|---|---|---|---|---|
| 4,386,357 | A * | 5/1983 | Patton | |
| 4,575,692 | A * | 3/1986 | Goldie | 333/13 |
| 5,444,452 | A * | 8/1995 | Itoh et al. | 343/700 MS |
| 5,614,917 | A * | 3/1997 | Kennedy et al. | 343/846 |
| 6,356,171 | B2 | 3/2002 | Fiedziuszko et al. | |
| 7,791,554 | B2 * | 9/2010 | Buxton et al. | 343/797 |
| 7,952,531 | B2 | 5/2011 | Liu | |
| 2011/0057853 | A1 | 3/2011 | Kim et al. | |
| 2011/0090129 | A1 | 4/2011 | Weily et al. | |

FOREIGN PATENT DOCUMENTS

| | | |
|---|---|---|
| EP | 0 355 898 | 2/1990 |
| JP | H02-270406 | 11/1990 |
| JP | A2000-295010 | 10/2000 |
| JP | A2004-356880 | 12/2004 |
| JP | A2011-061754 | 3/2011 |

OTHER PUBLICATIONS

Nakano, H., et al.; "A Cavity-Backed Rectangular Aperture Antenna with Application to a Tilted Fan Beam Array Antenna;" IEEE Transactions on Antennas and Propagation; vol. 51; No. 4; Apr. 2003; pp. 712-718.
Awida, M.H., et al.; "Development of a Substrate-Integrated Ku-Band Cavity-Backed Microstrip Patch Sub-Array of Dual Linear/Circular Polarization for DBS Application;" IEEE Radio and Wireless Symposium (RWS); 2010; pp. 92-95.
Joseph, R., et al.; "Broadband Circularly Polarized Cavity-backed Antenna;" IEEE; 2010; pp. 426-430.
Hung, K.F., et al.; "Novel Broadband Circularly Polarized Cavity-Backed Aperture Antenna With Traveling Wave Excitation;" IEEE Transactions on Antennas and Propagation; vol. 58; No. 1; Jan. 2010; pp. 35-42.
English language translation of abstract of JP A2004-356880 (published Dec. 16, 2004).

* cited by examiner

*Primary Examiner* — Tho G Phan
(74) *Attorney, Agent, or Firm* — McClure, Qualey & Rodack, LLP

(57) ABSTRACT

A circular polarization antenna includes a substrate, a ground plane, a tuning stub, a feeding element, and a cavity structure. The substrate has a first surface and a second surface. The feeding element is disposed on the first surface of the substrate. The ground plane is disposed on the second surface of the substrate and has a hole. The tuning stub is disposed on the second surface of the substrate and connected to the edge of the hole. The cavity structure is connected to the ground plane and configured to reflect an electromagnetic wave.

31 Claims, 12 Drawing Sheets

600(610)

1110

1120

1130

1140

1150

1160

1170

CIRCULAR POLARIZATION ANTENNA

BACKGROUND OF THE INVENTION

1. Field of the Invention

The disclosure generally relates to a circular polarization antenna, and more particularly, relates to a circular polarization antenna with high antenna gain.

2. Description of the Related Art

With respect to wireless data communications, antennas play an important role for transmitting and receiving electromagnetic waves. Usually, the antennas should be provided with omni-directional radiation patterns in the azimuth direction, and null patterns in the top direction. Therefore, a rod-like antenna, such as a dipole antenna, is considered to be suitable for transmitting and receiving vertically polarized waves and thus is widely applied to communication devices nowadays.

In a wireless communication system, data signals may be reflected from many surrounding objects so that the reflected waves may combine with the data signals in a constructive or destructive manner. Though the dipole antenna can be employed to receive and transmit the vertically polarized waves, multi-path interference, diffraction or reflection occurring in the surroundings may change the vertically polarized waves in phase for long-distance communications. Even worse, data signals may be altered from the vertically polarized waves to horizontally polarized waves that can not be received by the dipole antenna thereby causing data loss. Thus, there is a need to provide an antenna that can process the vertically polarized waves and the horizontally polarized waves as well.

BRIEF SUMMARY OF THE INVENTION

In one exemplary embodiment, the disclosure is directed to a circular polarization antenna, comprising: a substrate, having a first surface and a second surface; a feeding element, disposed on the first surface; a ground plane, disposed on the second surface, and having a hole; a tuning stub, disposed on the second surface, and connected to the edge of the hole; and a cavity structure, connected to the ground plane, and configured to reflect an electromagnetic wave.

In another exemplary embodiment, the disclosure is directed to a circular polarization antenna, comprising: a substrate, having a first surface and a second surface; a feeding element, disposed on the first surface; a ground plane, disposed on the second surface, and having a hole; a first tuning stub, disposed on the second surface, and connected to the edge of the hole; and a second tuning stub, disposed on the second surface, and connected to the edge of the hole.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
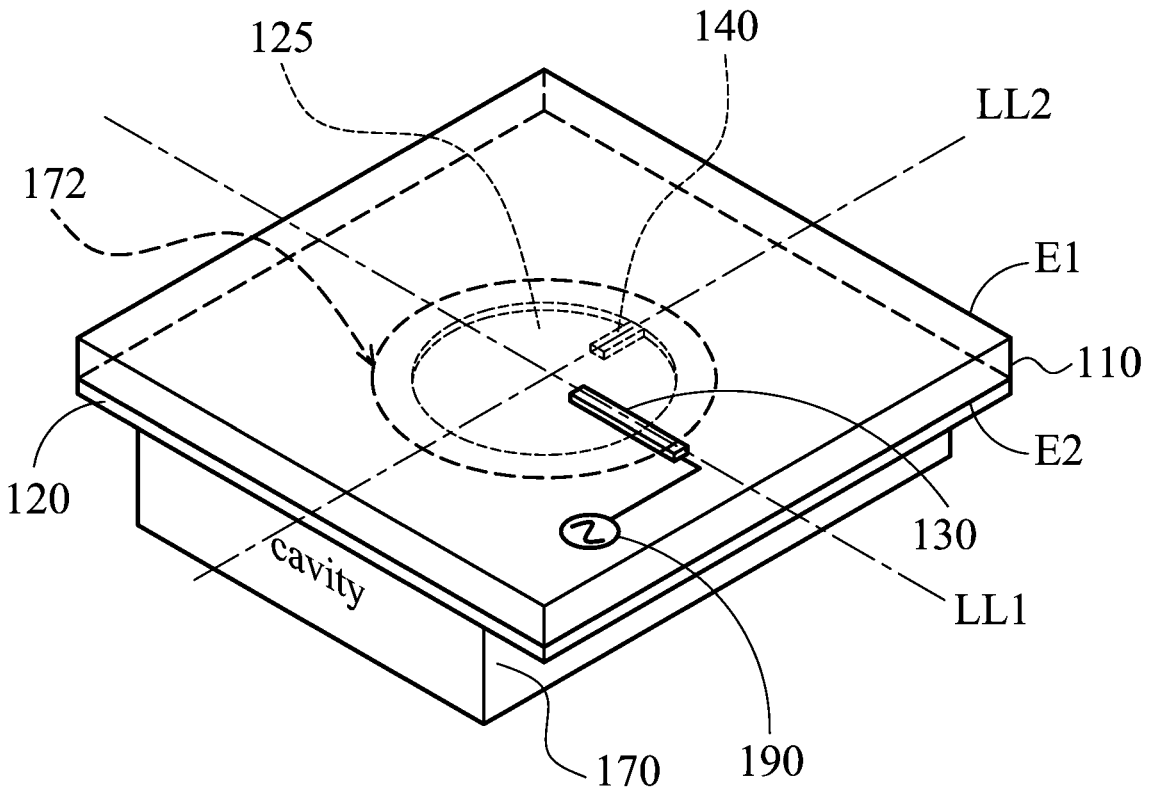
FIG. 1A is a pictorial drawing for illustrating a circular polarization antenna according to an embodiment of the invention.
Figure 1B:
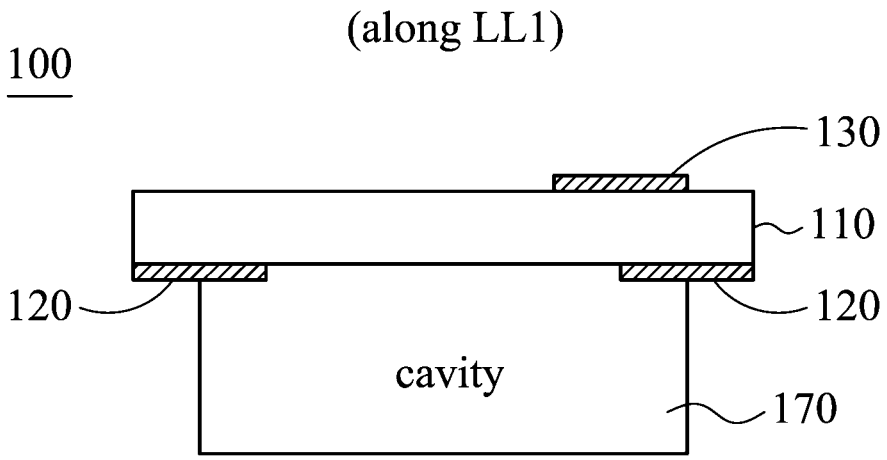
FIG. 1B is a sectional drawing along a line for illustrating the circular polarization antenna according to the embodiment of the invention.
Figure 1C:
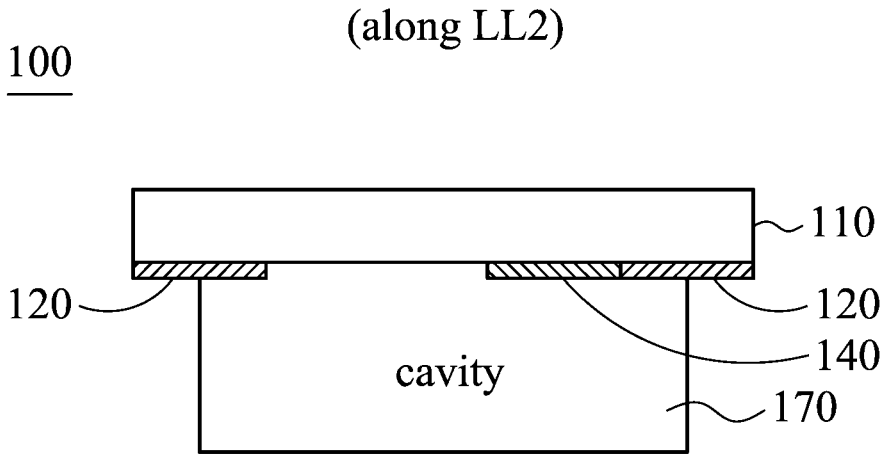
FIG. 1C is another sectional drawing along another line for illustrating the circular polarization antenna according to the embodiment of the invention.

FIG. 1A is a pictorial drawing for illustrating a circular polarization antenna 100 according to an embodiment of the invention. FIG. 1B is a sectional drawing along a line LL1 for illustrating the circular polarization antenna 100 according to the embodiment of the invention. FIG. 1C is another sectional drawing along another line LL2 for illustrating the circular polarization antenna 100 according to the embodiment of the invention. As shown in FIGS. 1A, 1B and 1C, the circular polarization antenna 100 comprises: a substrate 110, a ground plane 120, a feeding element 130, a tuning stub 140, and a cavity structure 170. The substrate 110 may be an FR4 substrate with a dielectric constant equal to 4.3 and be 0.6 mm in thickness. The ground plane 120, the feeding element 130 and the tuning stub 140 may be made of metal, such as silver or copper.

The substrate 110 has two surfaces E1 and E2, wherein the surface E1 is opposite to the surface E2. The feeding element 130 is disposed on the surface E1, wherein one end of the feeding element 130 may be electrically coupled to a signal source 190 so as to receive an input signal. The ground plane 120 is disposed on the surface E2 and has a hole 125. The hole 125 may have a circular shape, a rectangular shape or other shapes. The tuning stub 140 is disposed on the surface E2 and electrically connected to the edge of the hole 125. In an embodiment, the feeding element 130 and the tuning stub 140 are both substantially straight, and the hole 125 has a circular shape, wherein the tuning stub 140 is perpendicular to the periphery of the hole 125. In other embodiments, the feeding element 130 may be T-shaped or taper-shaped.

The cavity structure 170 is electrically connected to the ground plane 120, and configured to reflect an electromagnetic wave. In one embodiment, the cavity structure 170 is substantially a hollow cylinder without a cap and is attached to the ground plane 120 (e.g., along a dashed line 172). The circular polarization antenna 100 may generate a left-hand circularly polarized wave and a right-hand circularly polarized wave concurrently. In some embodiments, the left-hand circularly polarized wave progresses upwardly, but the right-hand circularly polarized wave progresses downwardly. Therefore, the cavity structure 170 is configured to substantially cover the hole 125 of the ground plane 120 to reflect electromagnetic waves in undesired directions so as to increase antenna gain. The cavity structure 170 is usually designed to be one fourth wave length ($\lambda/4$) in height, wherein the one fourth wave length may be adjusted according to a central operating frequency of the circular polarization antenna. There are a variety of cavity structures, and they will be illustrated as follows.

Figure 2:
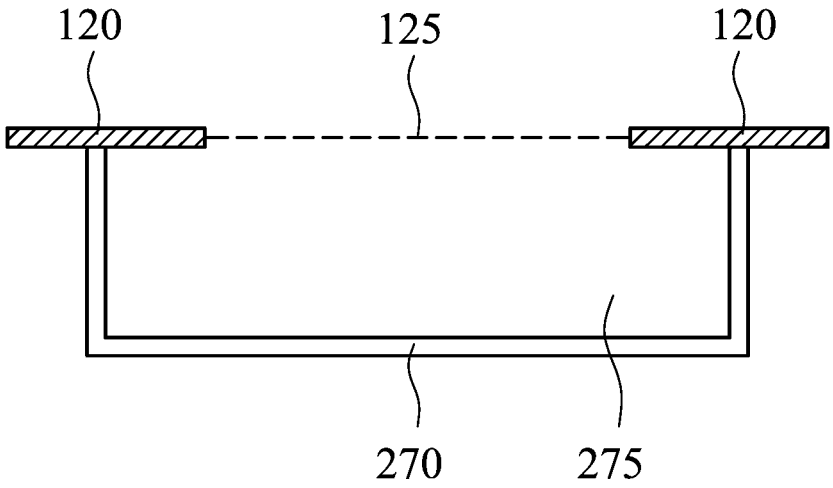
FIG. 2 is a sectional drawing for illustrating a cavity structure attached to a ground plane according to an embodiment of the invention.

FIG. 2 is a sectional drawing for illustrating a cavity structure 270 attached to the ground plane 120 according to an embodiment of the invention. As shown in FIG. 2, the cavity structure 270 is a hollow metal shell configured to cover the hole 125 of the ground plane 120. In some embodiments, the hollow metal shell is full of a medium 275, such as an FR4 medium or air. The hollow metal shell is usually designed to be one fourth wave length ($\lambda/4$) in height, wherein the one fourth wave length may be adjusted according to a central operating frequency of the circular polarization antenna.

Figure 3A:
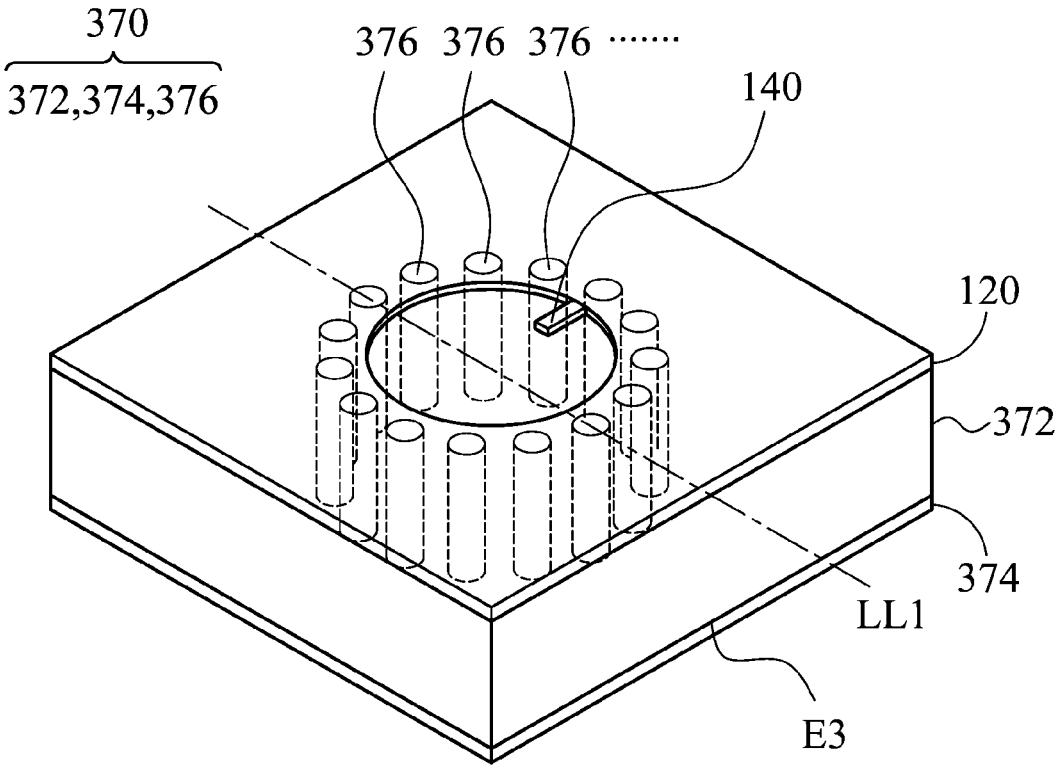
FIG. 3A is a pictorial drawing for illustrating a cavity structure attached to a ground plane according to another embodiment of the invention.
Figure 3B:
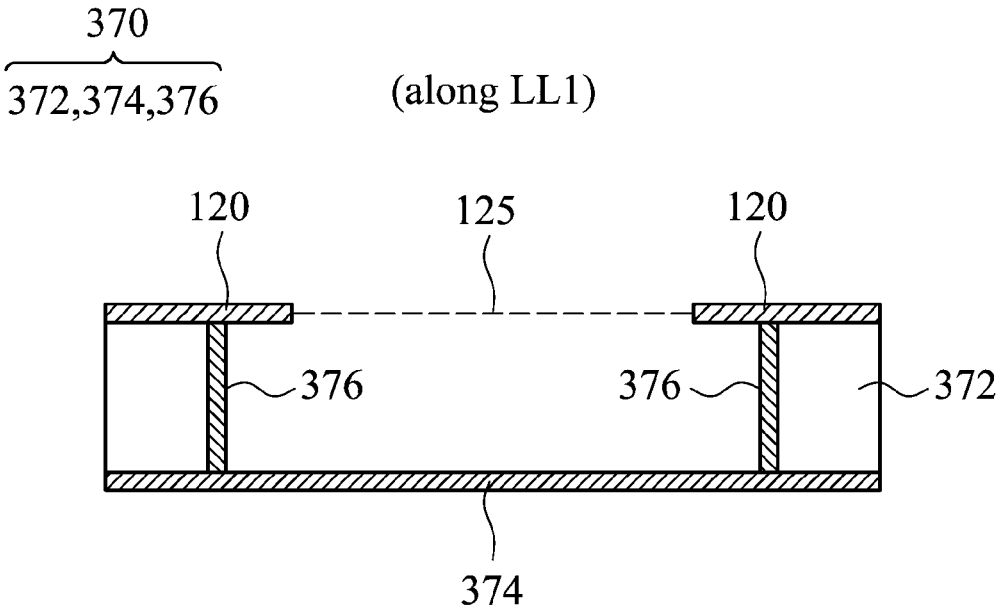
FIG. 3B is a sectional drawing along a line for illustrating the cavity structure attached to the ground plane according to the embodiment of the invention.

FIG. 3A is a pictorial drawing for illustrating a cavity structure 370 attached to the ground plane 120 according to another embodiment of the invention. FIG. 3B is a sectional drawing along a line LL1 for illustrating the cavity structure 370 attached to the ground plane 120 according to the embodiment of the invention. As shown in FIGS. 3A and 3B, the cavity structure 370 comprises: a cavity substrate 372, a cavity ground plane 374, and a plurality of vias 376. The cavity substrate 372 has two surfaces, one of which is attached to the ground plane 120. The cavity ground plane 374 is disposed on the other surface E3 of the cavity substrate 372. The vias 376 are formed through the cavity substrate 372, and substantially surrounds the hole 125. The plurality of vias 376 are further electrically connected between the ground plane 120 and the cavity ground plane 374. The cavity substrate 372 may be an FR4 substrate with a dielectric constant equal to 4.3 and be one fourth wave length ($\lambda/4$) in thickness, wherein the one fourth wave length may be adjusted according to a central operating frequency of the circular polarization antenna. The cavity ground plane 374 and the plurality of vias 376 may be made of metal, such as silver or copper. In one embodiment, the plurality of vias 376 are disposed at intervals of a predetermined distance D1 and disposed along a circular path. In a preferred embodiment, the predetermined distance D1 is smaller than 0.6 mm so as to reduce leakage waves.

Figure 4A:
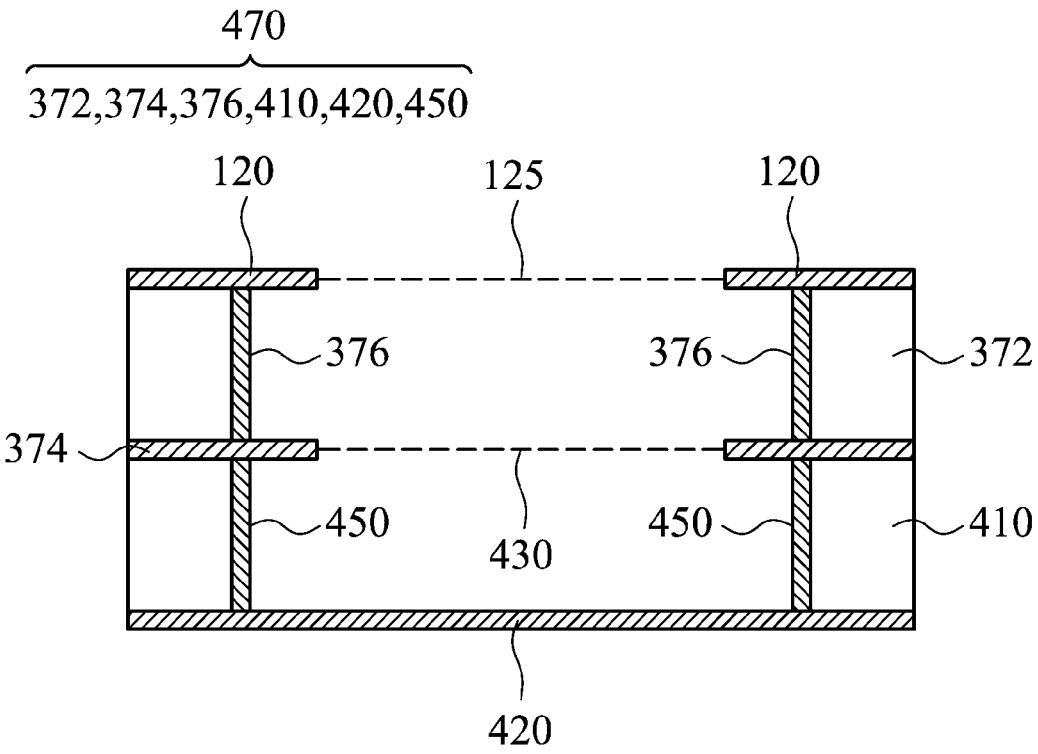
FIG. 4A is a sectional drawing for illustrating a cavity structure attached to a ground plane according to an embodiment of the invention.
Figure 4B:
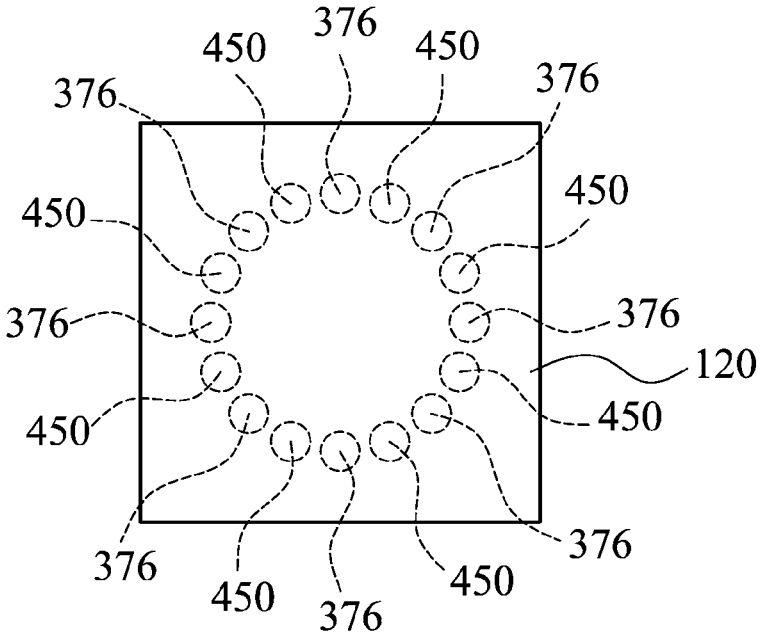
FIG. 4B is a vertical view for illustrating the cavity structure attached to the ground plane according to the embodiment of the invention.

FIG. 4A is a sectional drawing for illustrating a cavity structure 470 attached to the ground plane 120 according to an embodiment of the invention. FIG. 4B is a vertical view for illustrating the cavity structure 470 attached to the ground plane 120 according to the embodiment of the invention. As shown in FIG. 4A, the cavity structure 470 comprises the cavity structure 370 and further comprises another cavity substrate 410, another cavity ground plane 420, and another plurality of vias 450. It is noted that in the embodiment, the cavity ground plane 374 has a hole 430 which is identical to the hole 125 of the ground plane 120. As shown in FIG. 4B, the plurality of vias 450 may be disposed to interlace with the plurality of vias 376. The cavity substrate 410 may be an FR4 substrate with a dielectric constant equal to 4.3. The cavity ground plane 420 and the plurality of vias 450 may be made of metal, such as silver or copper. The cavity structure 470 is usually designed to be one fourth wave length ($\lambda/4$) in height, wherein the one fourth wave length may be adjusted according to a central operating frequency of the circular polarization antenna.

In an embodiment, the sizes of elements of the circular polarization antenna 100 are as follows: the hole 125 of the ground plane 120 has a circular shape with a radius equal to 1.3 mm; the tuning stub 140 is straight and is 0.75 mm in length and 0.1 mm in width; and the cavity structure 170 is 0.6 mm in height. It is noted that all sizes of elements may be adjusted so as to cover desired frequency bands.

Figure 5:
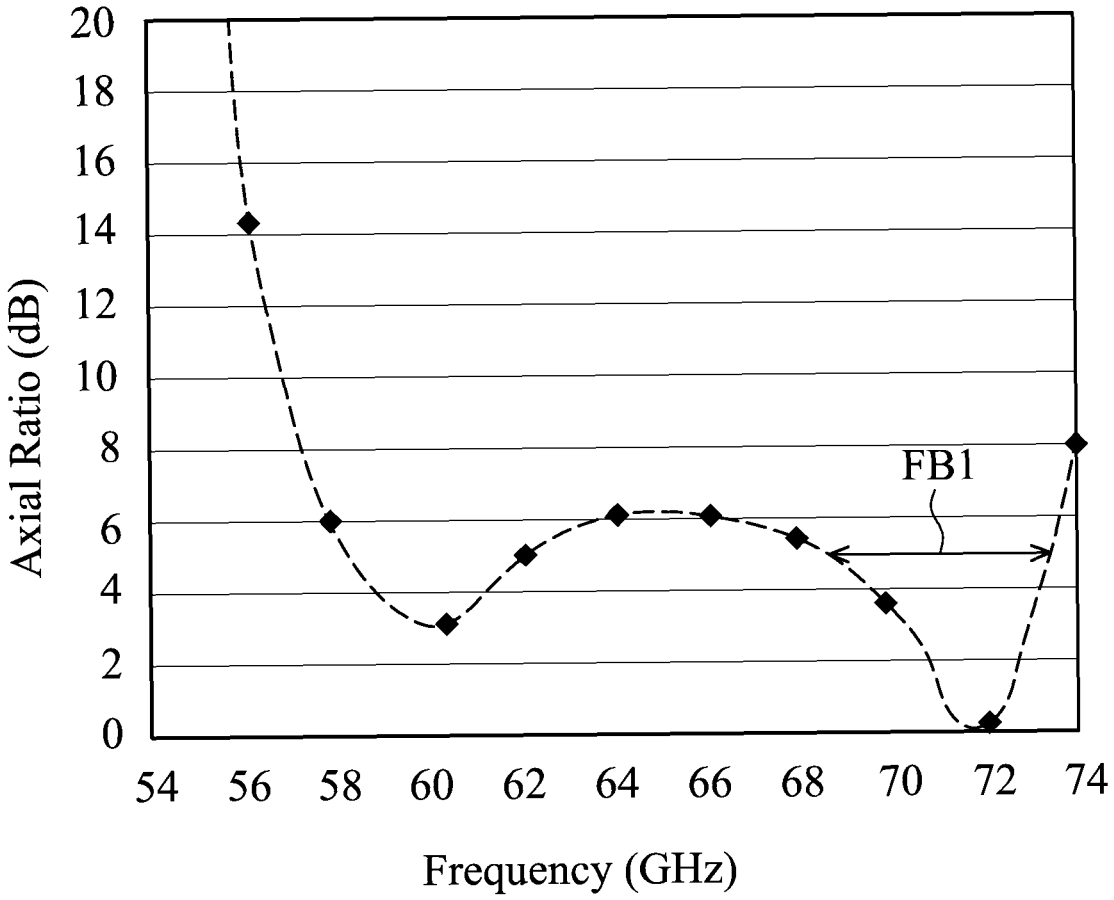
FIG. 5 is a diagram for illustrating an axial ratio (AR) of the circular polarization antenna according to an embodiment of the invention.

FIG. 5 is a diagram for illustrating an axial ratio (AR) of the circular polarization antenna 100 according to an embodiment of the invention. The vertical axis represents the axial ratio (unit: dB), and the horizontal axis represents operating frequency (unit: GHz). The feeding element 130, the tuning stub 140, and a part of the ground plane 120 around the hole 125 are excited to form a frequency band FB1. In an embodiment, the frequency band FB1 is approximately from 69 GHz to 73 GHz, wherein the axial ratio of the circular polarization antenna 100 is smaller than 5 dB within the frequency band FB1. It is noted that the frequency band FB1 may be adjusted according to different sizes of elements.

Figure 6:
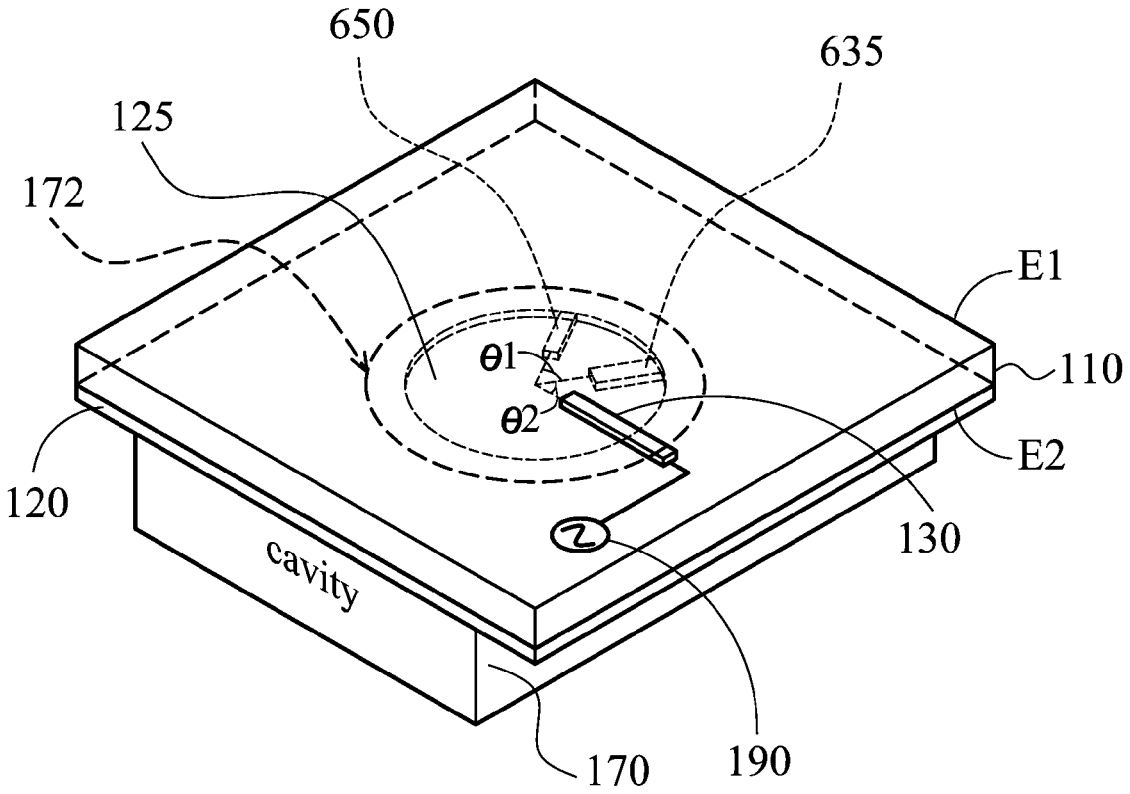
FIG. 6 is a pictorial drawing for illustrating a circular polarization antenna according to another embodiment of the invention.

FIG. 6 is a pictorial drawing for illustrating a circular polarization antenna 600 according to another embodiment of the invention. The circular polarization antenna 600 may comprise one or more antenna elements. In the embodiment, the circular polarization antenna 600 consists of one antenna element 610. The antenna element 610 is similar to the circular polarization antenna 100. The only difference between them is that the antenna element 610 comprises two tuning stubs 635 and 650. The tuning stubs 635 and 650 are disposed on the surface E2 of the substrate 110, and are electrically connected to the edge of the hole 125 of the ground plane 120, wherein the tuning stubs 635 and 650 have different connection positions. In an embodiment, the feeding element 130 and the tuning stubs 635 and 650 are all substantially straight, and the hole 125 has a circular shape, wherein the tuning stubs 635 and 650 are perpendicular to the periphery of the hole 125. An angle $\theta$1 between the tuning stubs 635 and 650 is smaller than 45 degrees. An angle $\theta$2 between the feeding element 130 and one of the tuning stubs 635 and 650 (e.g., the closer tuning stub 635) is smaller than 90 degrees. In other embodiments, the feeding element 130 may be T-shaped or taper-shaped. It is noted that the cavity structure 170 may be removed from the antenna element 610 in some embodiments.

In an embodiment, the sizes of elements of the antenna element 610 are as follows: the hole 125 of the ground plane 120 has a circular shape with a radius equal to 1.3 mm; each of the tuning stubs 635 and 650 is straight and is 0.75 mm in length and 0.1 mm in width; and the cavity structure 170 is 0.6 mm in height. It is noted that all sizes of elements may be adjusted so as to cover desired frequency bands.

Figure 7:
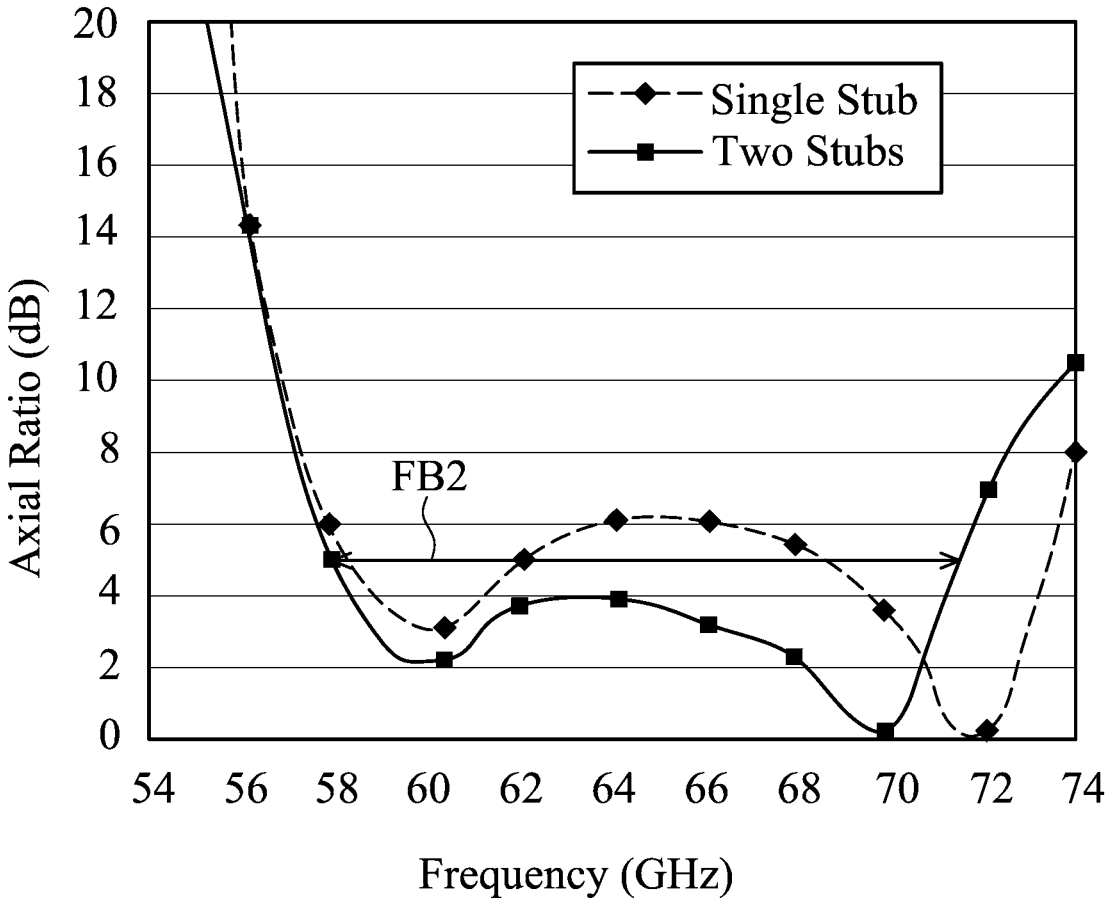
FIG. 7 is a diagram for illustrating an axial ratio (AR) of the circular polarization antenna according to an embodiment of the invention.

FIG. 7 is a diagram for illustrating an axial ratio (AR) of the circular polarization antenna 600 according to an embodiment of the invention. The vertical axis represents the axial ratio (unit: dB), and the horizontal axis represents operating frequency (unit: GHz). There are a dashed line and a solid line in FIG. 7. The solid line corresponds to the circular polarization antenna 600 with two tuning stubs, and the dashed line corresponds to the circular polarization antenna 100 with a single stub. In comparison with the single stub, the two stubs cause the circular polarization antenna 600 to have a wide frequency bandwidth. The feeding element 130, the tuning stubs 635 and 650, and a part of the ground plane 120 around the hole 125 is excited to form a frequency band FB2. In an embodiment, the frequency band FB2 is approximately from 58 GHz to 71 GHz, wherein the axial ratio of the circular polarization antenna 600 is smaller than 5 dB within the frequency band FB2. It is noted that the frequency band FB2 may be adjusted according to different sizes of elements.

Figure 8A:
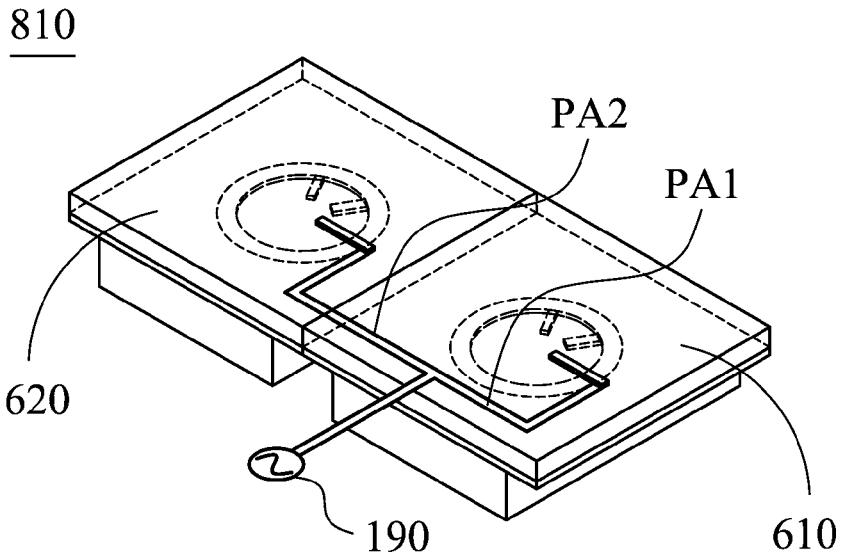
FIG. 8A is a pictorial drawing for illustrating a circular polarization antenna according to an embodiment of the invention.

FIG. 8A is a pictorial drawing for illustrating a circular polarization antenna 810 according to an embodiment of the invention. The circular polarization antenna 810 comprises two antenna elements 610 and 620. The antenna element 620 is identical to the antenna element 610. The antenna elements 610 and 620 are arranged so as to form a sequential rotation array. In other words, the antenna elements 610 and 620 have different input signal phases. As shown in FIG. 8A, the feeding element of the antenna element 610 is electrically coupled to the signal source 190 through a signal path PA1, while the feeding element of the antenna element 620 is electrically coupled to the signal source 190 through another signal path PA2. Since the signal path PA2 is longer than the signal path PA1, an input signal of the antenna element 620 lags that of the antenna element 610 by a predetermined angle, which may be 90 degrees. The sequential rotation array can improve frequency bandwidth and antenna gain of the circular polarization antenna.

Figure 8B:
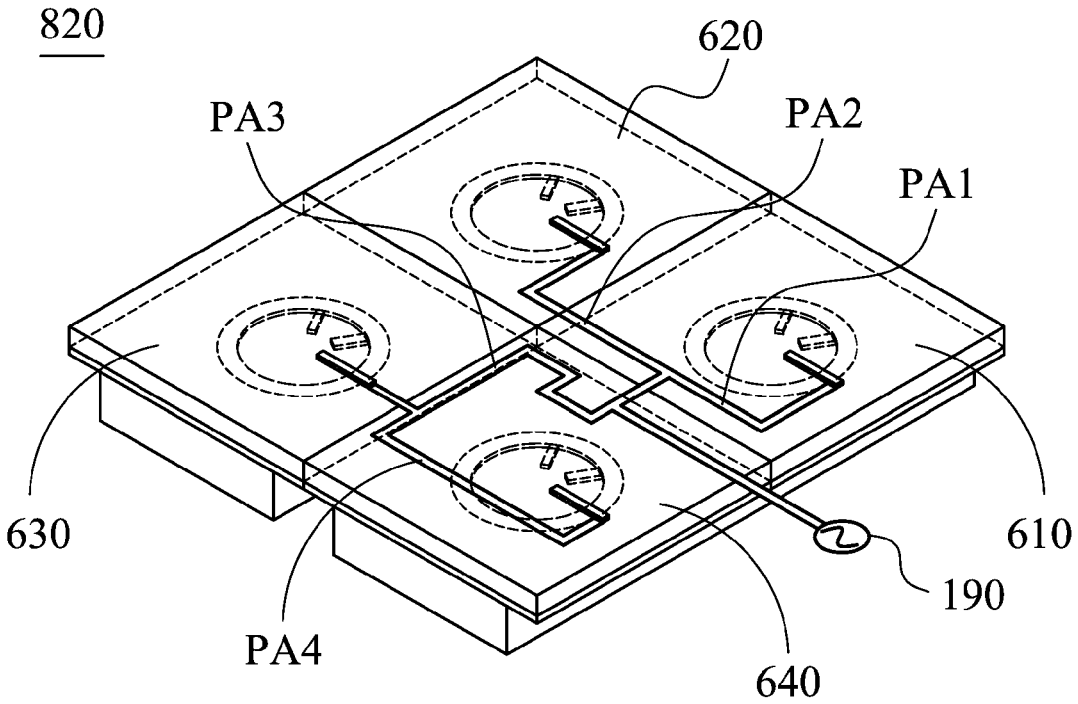
FIG. 8B is a pictorial drawing for illustrating a circular polarization antenna according to another embodiment of the invention.

FIG. 8B is a pictorial drawing for illustrating a circular polarization antenna 820 according to another embodiment of the invention. The circular polarization antenna 820 comprises four antenna elements 610, 620, 630 and 640. Each of the antenna elements 620, 630 and 640 is identical to the antenna element 610. The antenna elements 610, 620, 630 and 640 are arranged so as to form a sequential rotation array. As shown in FIG. 8B, the four feeding elements of the antenna elements 610, 620, 630 and 640 are electrically coupled to the signal source 190 through four signal paths PA1, PA2, PA3 and PA4, respectively. In one embodiment, the antenna elements 610, 620, 630 and 640 have input signal phases equal to 0, 90, 180 and 270 degrees, respectively. The sequential rotation array can improve frequency bandwidth and antenna gain of the circular polarization antenna.

Similarly, the circular polarization antenna 100 as shown in FIGS. 1A, 1B and 1C may have more identical antenna elements arranged to form a sequential rotation array.

Figure 9:
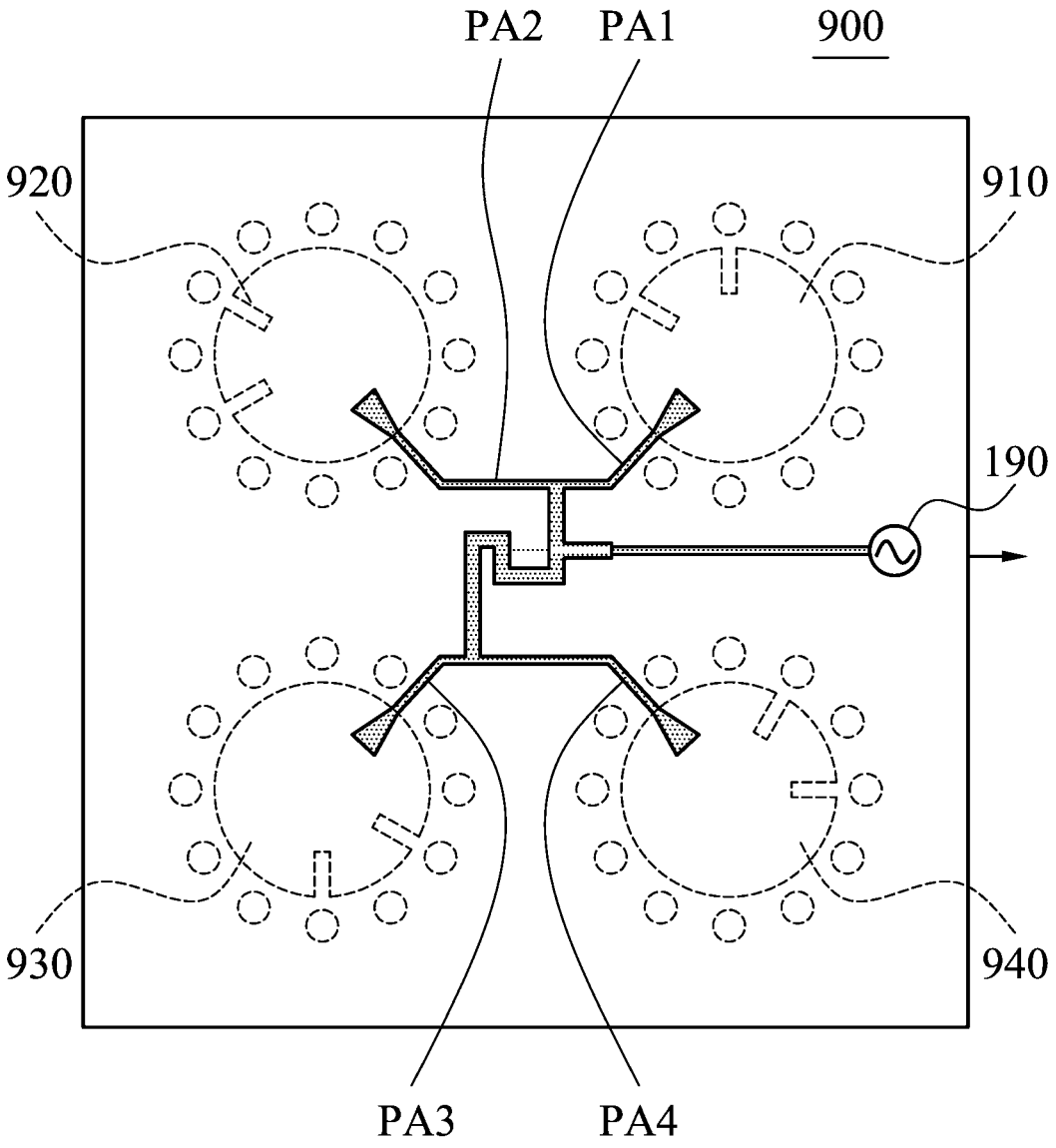
FIG. 9 is a vertical view for illustrating a circular polarization antenna according to an embodiment of the invention.

FIG. 9 is a vertical view for illustrating a circular polarization antenna 900 according to an embodiment of the invention. As shown in FIG. 9, the circular polarization antenna 900 comprises four antenna elements 910, 920, 930 and 940 which are arranged so as to form a sequential rotation array. In one embodiment, the antenna elements 910, 920, 930 and 940 have input signal phases equal to 0, 90, 180 and 270 degrees, respectively. Each of the antenna elements 910, 920, 930 and 940 comprises two tuning stubs and the cavity structure 370 as shown in FIGS. 3A and 3B. Furthermore, each of them has a feeding element with a taper shape.

Figure 10:
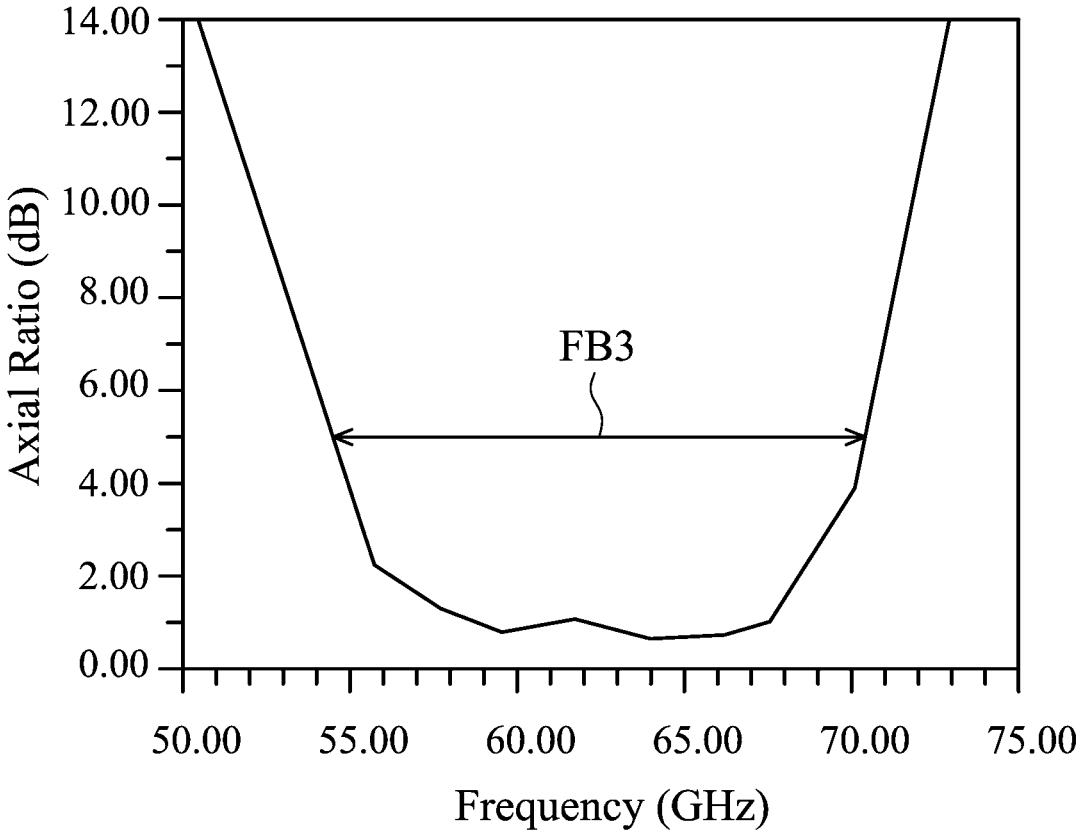
FIG. 10 is a diagram for illustrating an axial ratio (AR) of the circular polarization antenna according to an embodiment of the invention.

FIG. 10 is a diagram for illustrating an axial ratio (AR) of the circular polarization antenna 900 according to an embodiment of the invention. The vertical axis represents the axial ratio (unit: dB), and the horizontal axis represents operating frequency (unit: GHz). The circular polarization antenna 900 with four antenna elements is excited to form an array frequency band FB3. In an embodiment, the array frequency band FB3 is approximately from 55 GHz to 70 GHz, wherein the axial ratio of the circular polarization antenna 900 is smaller than 5 dB within the array frequency band FB3. It is noted that the array frequency band FB3 may be adjusted according to different sizes of elements.

The ground planes of the invention may have holes with different shapes, and have one or more tuning stubs. They will be illustrated as follows.

Figure 11A:
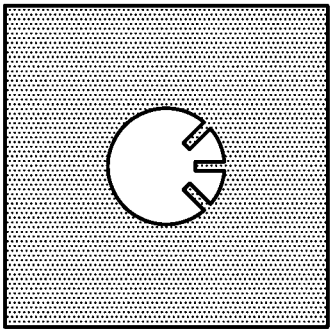
FIG. 11A is a diagram for illustrating a ground plane according to an embodiment of the invention.

FIG. 11A is a diagram for illustrating a ground plane 1110 according to an embodiment of the invention. As shown in FIG. 11A, the ground plane 1110 has a hole with a circular shape. There are three tuning stubs electrically connected to the edge of the hole of the ground plane 1110.

Figure 11B:
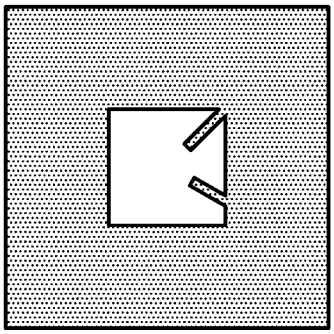
FIG. 11B is a diagram for illustrating a ground plane according to an embodiment of the invention.

FIG. 11B is a diagram for illustrating a ground plane 1120 according to an embodiment of the invention. As shown in FIG. 11B, the ground plane 1120 has a hole with a rectangular shape. There are two tuning stubs electrically connected to the edge of the hole of the ground plane 1120.

Figure 11C:
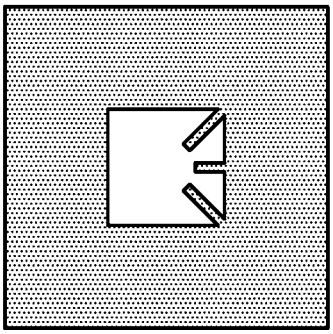
FIG. 11C is a diagram for illustrating a ground plane according to an embodiment of the invention.

FIG. 11C is a diagram for illustrating a ground plane 1130 according to an embodiment of the invention. As shown in FIG. 11C, the ground plane 1130 has a hole with a rectangular shape. There are three tuning stubs electrically connected to the edge of the hole of the ground plane 1130.

Figure 11D:
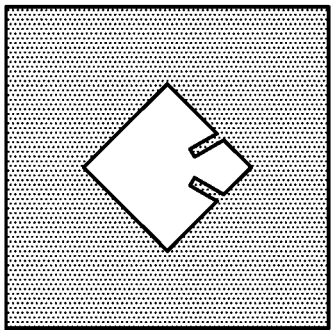
FIG. 11D is a diagram for illustrating a ground plane according to an embodiment of the invention.

FIG. 11D is a diagram for illustrating a ground plane 1140 according to an embodiment of the invention. As shown in FIG. 11D, the ground plane 1140 has a hole with a rectangular shape. There are two tuning stubs electrically connected to the edge of the hole of the ground plane 1140. It is noted that the hole of the ground plane 1140 is rotated by an angle in comparison to FIG. 11B.

Figure 11E:
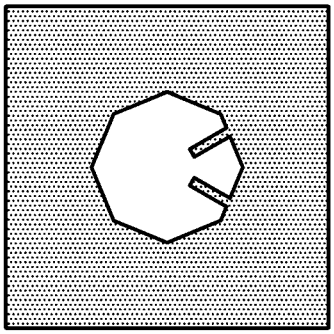
FIG. 11E is a diagram for illustrating a ground plane according to an embodiment of the invention.

FIG. 11E is a diagram for illustrating a ground plane 1150 according to an embodiment of the invention. As shown in FIG. 11E, the ground plane 1150 has a hole with a regular octagon. There are two tuning stubs electrically connected to the edge of the hole of the ground plane 1150.

Figure 11F:
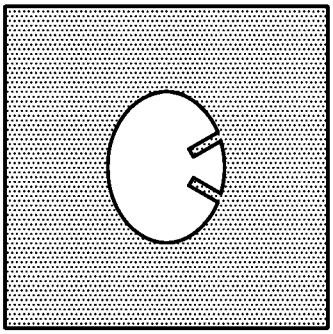
FIG. 11F is a diagram for illustrating a ground plane according to an embodiment of the invention.

FIG. 11F is a diagram for illustrating a ground plane 1160 according to an embodiment of the invention. As shown in FIG. 11F, the ground plane 1160 has a hole with an oval shape. There are two tuning stubs electrically connected to the edge of the hole of the ground plane 1160.

Figure 11G:
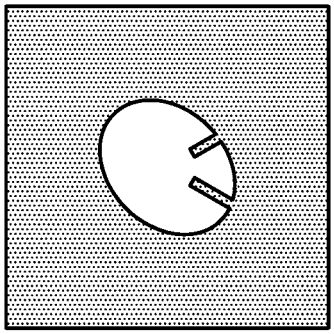
FIG. 11G is a diagram for illustrating a ground plane according to an embodiment of the invention.

FIG. 11G is a diagram for illustrating a ground plane 1170 according to an embodiment of the invention. As shown in FIG. 11G, the ground plane 1170 has a hole with an oval shape. There are two tuning stubs electrically connected to the edge of the hole of the ground plane 1170. It is noted that the hole of the ground plane 1170 is rotated by an angle in comparison to FIG. 11F.

The circular polarization antennas of the invention provide high antenna gain and wide frequency bandwidth. They can be applied to a variety of mobile devices for high speed communication.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A circular polarization antenna, comprising:
a substrate, having a first surface and a second surface;
a feeding element, disposed on the first surface;
a ground plane, disposed on the second surface, and having a hole;
a tuning stub, disposed on the second surface, and connected to the edge of the hole; and
a cavity structure, connected to the ground plane, and configured to reflect an electromagnetic wave,
wherein the tuning stub extends substantially parallel to the ground plane.

2. The circular polarization antenna as claimed in claim 1, wherein the hole has a circular shape.

3. The circular polarization antenna as claimed in claim 1, wherein the feeding element is substantially straight.

4. The circular polarization antenna as claimed in claim 1, wherein the tuning stub is substantially straight.

5. The circular polarization antenna as claimed in claim 1, wherein the feeding element, the tuning stub and a part of the ground plane are excited to form a frequency band.

6. The circular polarization antenna as claimed in claim 5, wherein the frequency band is approximately from 69 GHz to 73 GHz.

7. The circular polarization antenna as claimed in claim 5, wherein an axial ratio of the circular polarization antenna is smaller than 5 dB within the frequency band.

8. The circular polarization antenna as claimed in claim 1, wherein the cavity structure is a hollow metal shell configured to cover the hole.

9. The circular polarization antenna as claimed in claim 1, wherein the cavity structure comprises:
a cavity substrate;
a cavity ground plane, disposed on a surface of the cavity substrate; and
a plurality of vias, formed through the cavity substrate, substantially surrounding the hole, and connected between the ground plane and the cavity ground plane.

10. The circular polarization antenna as claimed in claim 9, wherein the plurality of vias are disposed at intervals of a predetermined distance.

11. The circular polarization antenna as claimed in claim 10, wherein the predetermined distance is smaller than 0.6 mm.

12. A circular polarization antenna, comprising:
a first antenna element, comprising:
a substrate, having a first surface and a second surface;
a feeding element, disposed on the first surface;
a ground plane, disposed on the second surface, and having a hole;
a first tuning stub, disposed on the second surface, and connected to the edge of the hole; and
a second tuning stub, disposed on the second surface, and connected to the edge of the hole,
wherein the first and second tuning stubs extend substantially parallel to the ground plane.

13. The circular polarization antenna as claimed in claim 12, wherein the hole has a circular shape.

14. The circular polarization antenna as claimed in claim 12, wherein the feeding element is substantially straight.

15. The circular polarization antenna as claimed in claim 12, wherein the first and second tuning stubs are substantially straight.

16. The circular polarization antenna as claimed in claim 12, wherein the feeding element, the first and second tuning stubs, and a part of the ground plane are excited to form a frequency band.

17. The circular polarization antenna as claimed in claim 16, wherein the frequency band is approximately from 58 GHz to 71 GHz.

18. The circular polarization antenna as claimed in claim 16, wherein an axial ratio of the circular polarization antenna is smaller than 5 dB within the frequency band.

19. The circular polarization antenna as claimed in claim 12, wherein the first antenna element further comprises:
a cavity structure, connected to the ground plane, and configured to reflect an electromagnetic wave.

20. The circular polarization antenna as claimed in claim 19, wherein the cavity structure is a hollow metal shell configured to cover the hole.

21. The circular polarization antenna as claimed in claim 19, wherein the cavity structure comprises:
a cavity substrate;
a cavity ground plane, disposed on a surface of the cavity substrate; and
a plurality of vias, formed through the cavity substrate, substantially surrounding the hole, and connected between the ground plane and the cavity ground plane.

22. The circular polarization antenna as claimed in claim 21, wherein the plurality of vias are disposed at intervals of a predetermined distance.

23. The circular polarization antenna as claimed in claim 22, wherein the predetermined distance is smaller than 0.6 mm.

24. The circular polarization antenna as claimed in claim 12, wherein a first angle between the first and second tuning stubs is smaller than 45 degrees.

25. The circular polarization antenna as claimed in claim 12, wherein a second angle between the feeding element and one of the first and second tuning stubs is smaller than 90 degrees.

26. The circular polarization antenna as claimed in claim 12, further comprising:
a second antenna element, identical to the first antenna element.

27. The circular polarization antenna as claimed in claim 26, wherein the first and second antenna elements are arranged so as to form a sequential rotation array.

28. The circular polarization antenna as claimed in claim 26, further comprising:
a third antenna element, identical to the first antenna element; and
a fourth antenna element, identical to the first antenna element.

29. The circular polarization antenna as claimed in claim 28, wherein the first, second, third, and fourth antenna elements are arranged so as to form a sequential rotation array.

30. The circular polarization antenna as claimed in claim 29, wherein the sequential rotation array is excited to form an array frequency band approximately from 55 GHz to 70 GHz.

31. The circular polarization antenna as claimed in claim 30, wherein an axial ratio of the circular polarization antenna is smaller than 5 dB within the array frequency band.

* * * * *